US011939754B2

(12) United States Patent
Wölfler et al.

(10) Patent No.: US 11,939,754 B2
(45) Date of Patent: Mar. 26, 2024

(54) SINK WITH BASIN AND SEPARATE MOVABLE INSERT PLATE WHICH RESTS ON SUPPORT VANES OF A LIFTING DEVICE

(71) Applicant: BSH Hausgeräte GmbH, Munich (DE)

(72) Inventors: Andreas Wölfler, Saalfelden (AT); Benjamin Reu, Prien am Chiemsee (DE); Brigitte Meyer, Chieming (DE)

(73) Assignee: BSH Hausgeräte GmbH, Munich (DE)

( * ) Notice: Subject to any disclaimer, the term of this patent is extended or adjusted under 35 U.S.C. 154(b) by 60 days.

(21) Appl. No.: 17/777,066

(22) PCT Filed: Nov. 11, 2020

(86) PCT No.: PCT/EP2020/081737
§ 371 (c)(1),
(2) Date: May 16, 2022

(87) PCT Pub. No.: WO2021/104871
PCT Pub. Date: Jun. 3, 2021

(65) Prior Publication Data

US 2022/0396942 A1 Dec. 15, 2022

(30) Foreign Application Priority Data

Nov. 29, 2019 (DE) ..... 102019218647.5

(51) Int. Cl.
*E03C 1/186* (2019.01)

(52) U.S. Cl.
CPC ..... *E03C 1/186* (2013.01)

(58) Field of Classification Search
CPC ..... E03C 1/181; E03C 1/186; A47B 77/06; A47L 17/02; A47L 19/02; A47J 47/20
See application file for complete search history.

(56) References Cited

U.S. PATENT DOCUMENTS 3,346,886 A * 10/1967 Kashiwamura ..... E03C 1/186 108/134
3,882,553 A 5/1975 Poiencot
2005/0067747 A1 3/2005 Erickson

FOREIGN PATENT DOCUMENTS

CN 109695275 A 4/2019
DE 3621151 A1 1/1988
DE 202010007075 U1 * 11/2010 ..... A47K 1/04
DE 202013006437 U1 * 12/2013 ..... E03C 1/181

OTHER PUBLICATIONS

National Search Report DE 10 2019 218 647.5 dated Aug. 21, 2020.
International Search Report PCT/EP2020/081737 dated Jan. 29, 2021.

* cited by examiner

*Primary Examiner* — Erin Deery
(74) *Attorney, Agent, or Firm* — Michael E. Tschupp; Andre Pallapies; Brandon G. Braun

(57) ABSTRACT

A sink includes a basin having a base wall and lateral walls adjoining the base wall, with the basin having a receiving area delimited by the base wall and the lateral walls. An insert plate separate from the basin is inserted into the receiving area of the basin and movable relative to the basin by a lifting apparatus. The lifting apparatus includes a lifting unit and at least two support vanes on which the insert plate sits. The support vanes are arranged on an upper end of the lifting unit and configured to protrude laterally in a horizontal plane beyond the lifting unit.

15 Claims, 3 Drawing Sheets

SINK WITH BASIN AND SEPARATE MOVABLE INSERT PLATE WHICH RESTS ON SUPPORT VANES OF A LIFTING DEVICE

CROSS-REFERENCES TO RELATED APPLICATIONS

This application is the U.S. National Stage of International Application No. PCT/EP2020/081737, filed Nov. 11, 2020, which designated the United States and has been published as International Publication No. WO 2021/104871 A1 and which claims the priority of German Patent Application, Serial No. 10 2019 218 647.5, filed Nov. 29, 2019, pursuant to 35 U.S.C. 119(a)-(d).

The contents of International Application No. PCT/EP2020/081737 and German Patent Application, Serial No. 10 2019 218 647.5 are incorporated herein by reference in their entireties as if fully set forth herein.

BACKGROUND OF THE INVENTION

One aspect of the invention relates to a sink with a basin. The basin has a base wall and lateral walls adjoining it. The basin has a receiving area delimited by the walls. Furthermore the sink has an insert plate separate from the basin, which is inserted into the receiving area.

These types of sink are known. Thus for example US 2005/0067747 A1 discloses a sink, which has a basin. Embodied in one piece on the base of the basin is a stanchion that extends upward. A plate can be placed on this stanchion. This forms a cutting board on which objects such as foodstuffs can be cut. Such an embodiment is disadvantageous to the extent that the integrated stanchion is always present and thus a basic design of the basin is complex in its shape and also the receiving area around it is embodied in a restricted manner. Furthermore the plate able to be placed on the stanchion is always only arranged at one height level. It can only be put on or removed by a user.

Furthermore a sink is disclosed in DE 362 1151 A1. Different inserts that can be inserted into the receiving area are provided separately from the basin. The inserts can be plates or further basin-like containers. These can be placed on the upper edge of the basin. The usability of a sink is also greatly reduced by this and the inserts must be fitted or removed by a user and are always only able to be positioned at one individual location.

BRIEF SUMMARY OF THE INVENTION

The object of the present invention is to create a sink with a basin and a separate insert plate, in which the insert plate is used in a more multifunctional manner.

One aspect of the invention relates to a sink with a basin. The basin has a base wall and lateral walls adjoining it. Furthermore the basin has a receiving area, which is delimited by the base wall and the lateral walls. The receiving area is open at the top. The sink has an insert unit separate from the basin, especially an insert plate, especially a contiguous insert plate without holes in it. This is able to be inserted into the receiving area or is inserted into it. Furthermore the sink has a lifting apparatus with which the insert plate is able to be moved in the height direction of the sink relative to the basin. This is made possible by a physical lifting apparatus of the sink. Thus a sink is now provided in which basically the option is created for arranging the insert unit at different height positions. Furthermore, this is also made possible by a lifting apparatus and does not have to take place manually by users themselves. Basically it is made possible for a continuous height adjustment of the insert plate to be made possible by the lifting apparatus. This thus enables countless height levels of the insert plate to be moved to and set.

The lifting apparatus has at least one lifting unit. Furthermore the lifting apparatus has at least two support vanes. The insert plate is placed on these support vanes. The support vanes are arranged at an upper end of the lifting unit and, viewed in a horizontal plan, are embodied to protrude laterally beyond the dimensions of the lifting unit. Such an embodiment of a lifting apparatus on the one hand enables a central unit, namely the lifting unit, to be embodied as an individual unit. It can thus be designed individually with regard to its dimensions and position. This means that the receiving area is not disproportionately restricted by a lifting unit designed in this way. The fact that it is embodied smaller in these horizontal dimensions than the two support vanes enables it to be designed as a space-saving unit in this regard. Since the insert plate is dimensioned significantly larger in this horizontal plane than the lifting unit, it is on the other hand especially advantageous to create a correspondingly adequate mechanical support structure here. This takes place with the support vanes. This also enables the insert plate to be held mechanically stable. The direct contact of the insert plate is thus especially not embodied by the lifting unit but by the support vanes. The support vanes thus create a very advantageous support structure. The support vanes in this context can also be embodied with a very specific shape and yet be lightweight. This also enables the support vanes to be embodied with a reduced weight. Since the support vanes must be raised with the lifting unit as well as the insert plate such a specific design of support vanes is advantageous, since they represent a relatively small additional weight in addition to the insert plate.

Preferably there is provision for the lifting unit to have an upper lifting segment in the height direction. Arranged on this upper lifting segment is at least one support vane. This makes possible a mechanically stable connection of the support vane to the lifting unit. In particular the at least one support vane is arranged movably on the lifting segment. This is a very advantageous embodiment since with this the support vane can be adjusted in its position individually. This enables a support vane to be adjusted independently of the lifting unit itself. This is advantageous for setting an exact horizontal location of the support vanes. This is advantageous in that it enables the insert plate to be located horizontally. By this being made possible by the support vanes the entire additional lifting unit does not also have to be aligned in its location in this regard. This can however also be made possible.

Furthermore what is also advantageously achieved by this design is that the support vanes can intentionally have their location adjusted relative to the lifting unit. This is especially advantageous when the insert plate is to be tilted from a horizontal location. Then the entire lifting unit does not have to be tilted but just the support vanes.

In an advantageous embodiment there is provision for the at least one support vane to be able to be pivoted about a horizontal axis on the lifting segment. In an advantageous way this makes possible a very simple yet still precise pivoted position of the support vane relative to the horizontal plane. This is how just a specific tilted position of the insert plane is then especially advantageously able to be achieved.

In an advantageous embodiment there is provision for the at least one support vane to be embodied in a V shape. This is an especially advantageous geometrical shape. This is because on the one hand the support vane then protrudes relatively far beyond the lifting unit in a plane at right angles to the height direction. A mechanical coupling projecting especially far with the insert plate which is larger in this regard is made possible by this. Undesired angled positions of the insert plate can be avoided especially advantageously with this. On the other hand a relatively lightweight support vane is created by this V-type design. This type of V-type bracket thus has two V arms oriented at an angle to one another. In particular these arms are embodied straight. Preferably the angle of these V arms is such that one arm is oriented in the direction of a first corner area and the second V arm is oriented to the adjacent second corner area of the rectangular insert plate. Especially when the insert plate is embodied with four corners a corresponding support structure can be embodied with two support vanes, which then preferably have four such V arms. This is then especially a star shape when considered as a whole. In particular it is embodied in an X shape.

In particular these V arms are oriented freely protruding in a horizontal plane. Preferably there is provision, when the two support vanes are embodied as separate components, for each of these two support vanes to be arranged movably on an upper lifting segment. In particular they can each be pivoted individually and independently of one another via two parallel horizontal axes.

In an advantageous embodiment there is provision for the insert plate to be arranged directly on the support vanes by a connection that can be released non-destructively. This is a further very advantageous embodiment. This is because on the one hand the insert plate can then be supported securely on the support vanes. On the other hand it can be reversibly removed again. This enables the insert plate to be cleaned on its own for example. Also access to the support vanes arranged below it and also to the entire lifting apparatus is then made possible more easily when the insert plate is removed. This is advantageous for cleaning purposes. This is also especially advantageous for installation and maintenance purposes, however.

There can be provision for the connection to be a mechanical connection. For example this connection can be a plug connection.

In addition to or instead of this there can be provision for this connection to be a magnetic connection. Likewise, in addition to or instead of this a snap-in connection can be provided.

In an advantageous embodiment there is provision for a recess geometry to be embodied on the underside of the insert plate. This recess geometry is in particular complementary to the geometry of the two support vanes. The insert plate can thus be put onto the support vanes from above and these support vanes then nestle into the recess geometry on the underside of the insert plate. An advantageous mechanical coupling is also made possible by this. Corresponding additional plug elements can be provided in these recesses and/or the support vanes. Likewise additional magnets can be provided.

Preferably there is provision for the insert plate to be embodied on its underside in the manner of a pyramid or a sphere. This is a further very advantageous embodiment. This is because this enables medium, in particular liquid medium, which gets down to the underside from the upper side through the edge area of the insert plate, to be discharged in a targeted manner. This type of uneven geometry allows the conveyance of liquid media on the underside advantageously to be undertaken in a directed manner. Thus a defined point can then also be embodied on the underside from which this liquid medium drips down into the basin. This enables a targeted drainage of medium, in particular liquid medium, from the underside to be undertaken at a specific point. This can then take place from example in the area above a drain opening, which is embodied in a base wall of the basin. Thereby the medium running off the insert plate, especially running off its underside, can drip or run directly into the drain opening.

In an advantageous embodiment, in addition to this or instead of this, there can be provision for the insert plate to be embodied with an air exhaust structure. The air exhaust structure is embodied to convey air formed below insert plate the away toward the edge of the insert plate. This is advantageous insofar as, when the insert plate is moved downward in the basin and thus the air that is present below the inset plate has to be discharged in a targeted manner, there is no corresponding buildup of air and no corresponding buildup of pressure between the insert plate and the base wall of the basin. A defined air exhaust structure of this type makes this discharge of air possible in an advantageous and directed manner.

Preferably there is provision for the lifting apparatus to have an adjustment unit. With this adjustment unit the support vanes are able to be set in a horizontal position in a common horizontal plane. This is especially advantageous in order also to be able to position the insert plate positioned on them in an exact horizontal location. In addition to or instead of this there can be provision for a horizontal setting of the support vanes to be set by the adjustment unit, in which an upper side of the insert plate is flush with an upper side of a visual element of the basin surrounding the insert plate on its outside edge. Such a visual element can be a decorative frame or an installation frame or an upper edge of the basin for example. An undesired tilting of the plate in relation to this edge-side visual element is avoided by this.

Preferably there is provision for the support vanes to extend as far as an outer third of the surface of the insert plate. Thereby the advantages already mentioned above of a support structure that is as stable as possible are achieved, which especially advantageously avoid an undesired tilting of the insert plate.

Preferably there is provision for the upper lifting segment to have a raised central bar on its upper side. The two support vanes are supported pivotably on opposite sides of this central bar in an advantageous manner. This is a further advantage. This is because on the one hand a raised structure projecting upward is thus created on which the support vanes can be simply supported and thus a better mobility of the support vanes is achieved. On the other hand, in the horizontal position of the support vanes, their upper side can be embodied flush with central bar. Thus a contiguous support surface for the insert plate is formed by the support vanes and the central bar. Thus the insert plate can rest on a large surface in an improved way in this central area.

Preferably there is provision for areas of the upper side to be embodied adjoining the central bar, on which the support vanes rest in their basic position. Thus a more stable abutment is created for the support vanes by this upper lifting segment. It is precisely the central or inner area of the support vanes that is supported stably from below.

Preferably there is provision for the support vanes to be able to be moved independently of one another relative to the lifting unit.

In an advantageous embodiment there can be provision for a support vane to be embodied in one piece. It can be embodied from plastic for example. Thus its weight is reduced and it is subject lower wear in relation to liquid or other media, which can occur in such a basin. There can also be an embodiment of a support vane in stainless steel, however.

There can be provision for an arm of such a bracket, as has been explained above, to be embodied as an uninterrupted plate strip. There can however also be provision for such an arm to be embodied as a frame, which in this context is effectively embodied as a skeletal arm and has a corresponding breakthrough.

In particular a plate receptacle for the insert plate is embodied in the upper area of the upper lifting segment. For example this plate receptacle can be realized as an injection molded part, especially as a 2K molded part. There can be provision for there to be at least one through-hole in this plate receptacle. An actuation element can extend from below through said hole, with which a support vane positioned on the plate receptacle can be lifted. In particular through this lifting there can be pivoting about a horizontal axis, so that a support vane is set at an angle and can thus be positioned tilted. Preferably a hole of this type or a breakthrough in the plate receptacle can be covered in the upper area by an elastic component. This enables media to be prevented from getting into this hole in the plate receptacle from above. The fact that this cover is embodied elastically enables the actuation element to act on this elastic element and deflect it upward. Thus a corresponding actuation force can be transmitted to the support vane and this can be tilted.

In an advantageous embodiment there is provision for an upper side of the insert plate to have a surface that amounts to at least 80 percent, especially at least 90 percent, especially at least 95 percent of the surface of the receiving area in a horizontal plane. The surface of the upper side is however less than 99 percent of this surface of the receiving area. Such dimensioning enables the insert plate to be embodied over practically the entire surface of the full width of the receiving area between the lateral walls and thus fill this receiving area almost completely, viewed in the horizontal plane. On the other hand however a small circumferential gap, especially between 3 mm and 15 mm, especially between 3 mm and 10 mm, is made possible, so that on the one hand a relative movement of the insert plate during a positioning or a change of position can take place unhindered. In particular direct contact and where necessary a side edge of the insert plate sliding along of the inner sides of the lateral wall can be avoided. On the one hand damage to the lateral walls is thus avoided and on the other hand damage to the insert plate and also to the lifting mechanism can also be avoided. Last but not least what is also advantageously achieved by this embodiment is that, through this gap between the edge of the insert plate and the inner sides of the lateral walls, liquid that is present on the upper side of the insert plate can run away into the receiving area without any problems.

Preferably the basin, especially on the base wall, has an outflow. Medium that is arranged in the basin and collects there can drain out via the outflow without any problems.

In particular the basin is embodied in one piece with the base wall and the lateral walls, in particular the basin is embodied from metal.

The base wall can be flat or slightly inclined or slightly curved. In particular there is provision for that point on the base wall, at which the outlet for an outflow of the sink is embodied, to be set furthest down as regards the height position.

There can be provision for the upper side of the plate to be embodied completely flat. It can however also have a slight curve. It is also possible for the upper side of the insert plate to be structured at least in some areas. A certain roughness can be achieved thereby. This enables undesired sliding off of objects placed thereon to be avoided in an improved manner. This is advantageous for example when a change in position of the insert plate occurs and there are still objects arranged on the upper side of the insert plate. Likewise it is possible for the upper side to have certain positioning areas. These can be indentations. For example such indentations can be embodied relatively small, however. This is advantageous for example for being able to position vessels such as a glass or the like more securely. This is in particular advantageous when a change of position is a tipping and/or a rotation. An undesired slipping off of such vessels is then avoided. Furthermore what is also achieved by such predetermined positioning areas is that when vessels are placed on the upper side of the insert plate and are to be filled from the faucet for example, during a rotational movement the water flowing out of the water faucet runs safely into the vessels and does not strike the insert plate by running past the edges of the vessels.

The lifting apparatus can have a lifting unit and a motor. The lifting unit can be moved at least in the height direction with the motor.

The positions and orientations given for the correct use and the correct arrangement of the sink are specified by the terms "up", "down", "forward", "backward", "horizontal", "vertical", "depth direction", "width direction", "height direction".

Further features of the invention emerge from the claims, the figures and the description of the figures. The features and combinations of features given in the description, as well as the features and combinations of features given in the below in the description of the figures and/or shown in the figures alone are not only able to be used in the combination specified in each case but also in other combinations or on their own, without departing from the scope of the invention. Thus embodiments of the invention that are not shown and explained explicitly in the figures, but which stem from and are able to be created from separated combinations of features from the explained embodiments are also to be seen as included and disclosed. Embodiments and combinations of features that thus do not have all features of an originally formulated independent claim are also to be seen as disclosed.

BRIEF DESCRIPTION OF THE DRAWINGS

Exemplary embodiments of the invention are explained below in greater detail with the aid of schematic drawings. In the figures.

DETAILED DESCRIPTION OF EXEMPLARY EMBODIMENTS OF THE PRESENT INVENTION

Figure 1:
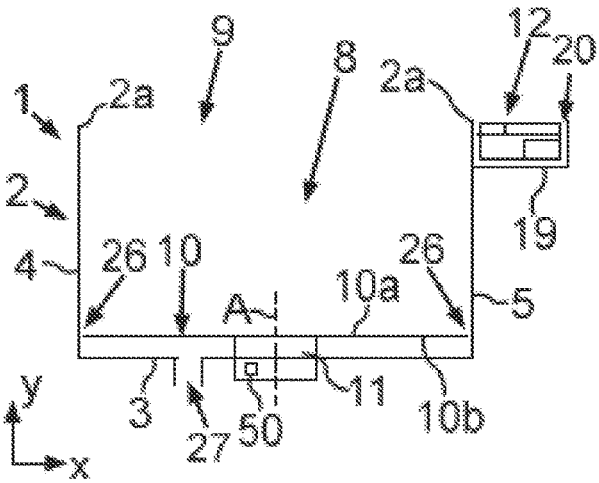
FIG. 1 shows a schematic sectional view through an exemplary embodiment of an inventive sink with an insert plate in a first position.

Elements that are the same or that have the same function are labeled with the same reference characters in the figures.

Shown in FIG. 1 in a schematic vertical sectional diagram (x-y plane with height direction y and width direction x) is a sink 1. The sink 1 has a basin 2. The basin 2 has a base wall 3 and also lateral walls 4, 5, 6 (FIG. 3) and 7 (FIG. 3) adjoining said wall and extending upward. The basin 2 is in particular in one piece. It is preferably embodied from metal. The basin 2 has a receiving area 8. The receiving area 8 is delimited by the said walls 3 to 7. Thus the basin 2 has an upper loading opening 9. Furthermore the sink 1 has an insert unit. The insert unit is in particular an insert plate 10. The insert plate 10 is especially embodied in one piece. The insert plate 10 is a separate component of the sink 1 from the basin 2. The sink 1 furthermore has a lifting apparatus 11. The insert plate is arranged on the lifting apparatus 11. In particular it is arranged on the lifting apparatus 11 so that it can be released therefrom in a non-destructive manner. The lifting apparatus enables the insert plate 10 to be moved relative to the basin 2. In this connection there can be a movement in the height direction (y direction) of the sink 1. In addition or instead of this there can be a rotation about a vertical axis A of the lifting apparatus 11. In addition or instead of this there can be a tilting of the insert plate 10. This means that the insert plate 10 can be set with its plane at an angle to a horizontal plane. It can thus be positioned inclined or at a slant. In FIG. 1 the insert plate 10 is shown in a typical position in the receiving area 8. In particular this is a position in which it is moved downward. The insert plate 10 is arranged in this regard directly adjacent to the base wall 3.

Figure 3:
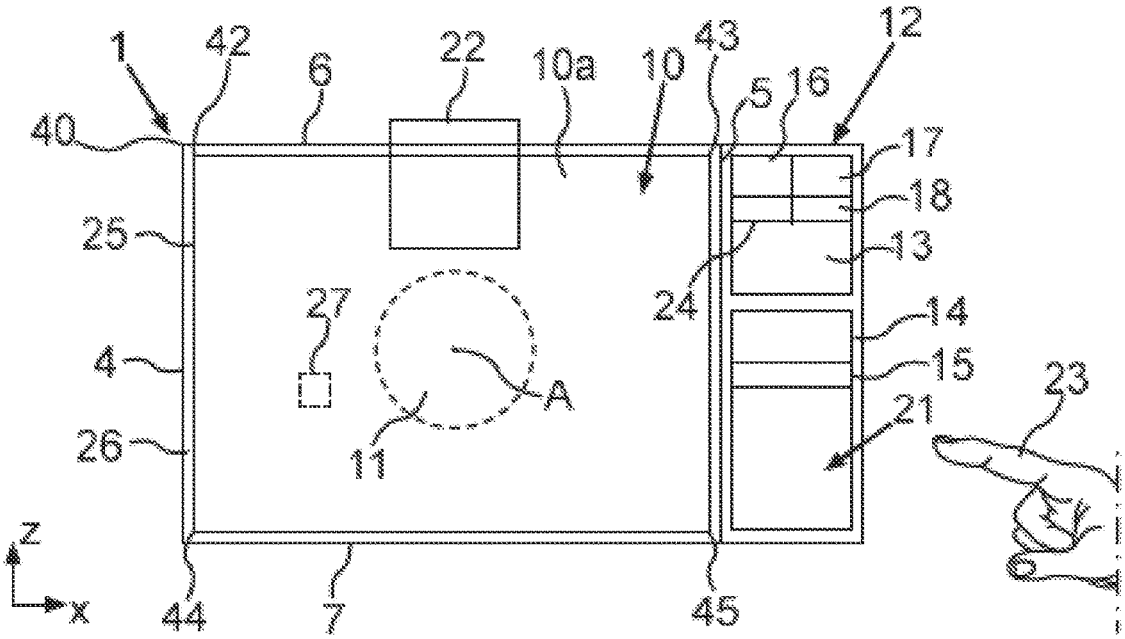
FIG. 3 shows an overhead view of an exemplary embodiment of a sink.

Preferably the sink 1 has an interaction unit 12. The interaction unit 12 can have a display unit 13 (FIG. 3). The interaction unit 12 can have an operating apparatus 14. The operating apparatus 14 can have one or more operating elements. The operating elements can be pushbuttons or switches or lever elements or rotary dials. The operating apparatus 14 can however, in addition to or as an alternative to said elements, also have a touch-sensitive operating panel 15. In an advantageous embodiment there can be provision for the interaction unit 12 to have at least one optical detection unit 16. The optical detection unit 16 can be a camera for example. The camera can be sensitive in the range of the spectrum visible to humans. The interaction unit 12, in addition or as an alternative to this, can also have an acoustic unit 17. This acoustic unit 17 can be embodied for receiving and/or for outputting voice signals. Furthermore the interaction unit 12 can have an identification unit 18. The identification unit 18 is embodied for recognition or for identification of a user of the sink 1. The identification unit 18 can also be embodied by the optical detection unit 16 for example. In addition to or instead of this however, the identification unit 18 can also have the acoustic unit 17 for example. This enables the user to be identified by evaluation of a user's voice signal. In addition to or instead of this the identification unit 18 can be embodied as a unit for acquiring and evaluating a biometric feature of a user. This can be a fingerprint sensor or a sensor for recognizing an iris pattern.

Figure 2:
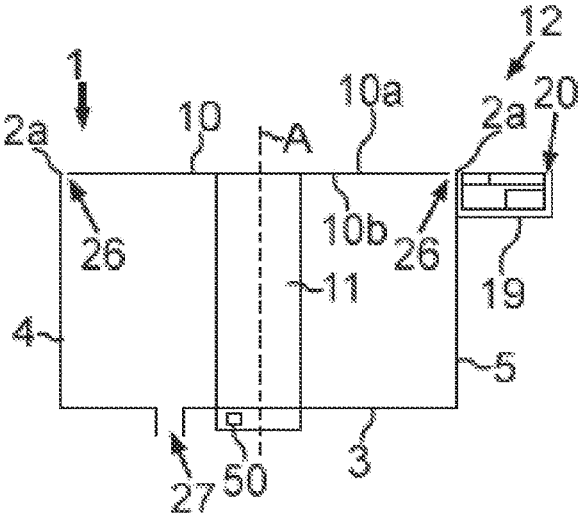
FIG. 2 shows the diagram of the sink in accordance with FIG. 2 with the insert plate in a second position different from FIG. 1.

As can be seen from FIGS. 1 to 3, the interaction unit 12 can be embodied to the side of and immediately adjacent to the basin 2. For example a receiving housing 19 open toward the top can be provided here. The receiving housing 19 can be embodied separately from the basin 2. It can also, however, be formed with the basin 2 such that it cannot be released in a non-destructive manner. In particular the receiving housing 19 can also be embodied in one piece with the basin 2. The lateral wall directly adjoining the receiving housing 19, here in the example the lateral wall 5, also forms a delimiting wall for the receiving volume 20 of the receiving housing 19.

Thus the receiving volume 20 is separated from the receiving area 8 for the basin.

Shown in FIG. 2 is the diagram in accordance with FIG. 1, but with the insert plate 10 shown in a different position to that in FIG. 1. In FIG. 2 the insert plate 10 is oriented horizontally, but moved upward, however. In particular, in the normal mode, this position represents the maximum possible height location. In particular in this position an upper side 10*a* of the insert plate 10 is flush with an upper edge 2*a* of the basin 2. In particular, in this position, the insert plate 10 forms a cover or a lid for the receiving area 8. This upper edge 2*a* can however also be an upper side of a mounting frame or a decorative frame, which is an element of the sink 1 for example. With the mounting frame the sink 1, in particular the basin 2, can be mounted in a cutout of a worktop. The basin 2 can be covered from above by a decorative frame. A gap between the basin 2 and a delimiting wall in the worktop, which delimits the cutout, can thus be covered from above. Such a decorative frame in particular represents an upper visual element of the arrangement.

In particular the sink 1 also has a control unit 21 (FIG. 3). The control unit 21 enables the lifting apparatus 11 to be operated. In particular the interaction unit 12 can also be operated by the control unit 21.

The sink 1 can, as can be seen in the simplified overhead view in FIG. 3, preferably also have a water faucet 22. The water faucet 22 represents a functional unit of the sink 1. Likewise the interaction unit 12, especially the operating apparatus 14, can be seen as a functional unit of the sink 1. A further functional unit of the sink 1 can be the insert plate 10. A further functional unit of the sink 1 can be the lifting apparatus 11.

The lifting apparatus 11 preferably has a lifting unit and a motor. These enable it to change its length or its height in the direction of the vertical axis A. Furthermore, in addition to or instead of this, it can be rotated about the vertical axis. This also enables a rotational movement about this vertical axis A to be made possible as a position or a change of position as a position of the insert plate 10. Last but not least the lifting apparatus 11 can also be set so that the insert plate can be set at an angle or inclined in relation to the horizontal plane.

The interaction unit 12 allows an operating state of the sink 1 to be seen and/or a change in the operating state of the sink 1 to be seen and/or an operating action of the user who is operating the sink 1, especially at least one functional element of the sink 1, to be seen. Depending on the recognition by the interaction unit 12, the lifting apparatus 11 is able to be operated to automatically change the position of the insert plate 10. Furthermore FIG. 3 also shows a schematic depiction of a finger 23 of a user. The interaction unit 12 is preferably embodied to detect a gesture of the user, especially of the finger 23. In particular the gesture is a contactless gesture. In addition to or instead of this however there can also be a direct operation of the operating apparatus 14 with the finger 23. There is provision for an operating state and/or a change of operating state to be able to be detected by the camera 16 and/or the acoustic unit 17 and/or the operating apparatus 14. An operating state can for example be a position of the operating apparatus 14 and/or a change in the operating state can be a change in the position of the operating apparatus 14.

A change in position of the insert plate 10 can be dependent on the type and/or strength and/or duration of an operating state of at least one functional unit of the sink 1 and/or a change in position can be dependent on the type and/or strength and/or duration of a change in operating state of at least one such functional unit of the sink 1.

The interaction unit 12 has a normal mode. In this mode the actual operation of the sink 1 is also detected. Furthermore the interaction unit 12 has a definition mode that differs from the normal mode. This can be set by a user for example. In this definition mode it is made possible for at least one user to define or predetermine at least one reference position of the insert plate 10. In particular such a reference position can be linked in this definition mode to a specific operating state of at least one functional unit of the sink 1 and/or to a defined change in operating state of at least one functional unit of the sink 1. At least one such reference position can be stored as a user profile in a memory unit 24 of the interaction unit 12.

In an advantageous embodiment there is provision for the surface shown in FIG. 3 (depth direction z and width direction x) of the upper side 10*a* to amount to at least 80 percent, especially at least 90 percent, especially at least 95 percent of the surface of the receiving area 8, which is viewed in a horizontal plane (in FIG. 3 the plane of the figure). In particular this surface of the upper side 10*a* is however less than 99 percent of this surface of the receiving area 8 in the said horizontal plane. What is achieved by this is that a circumferential edge 25 of the insert plate 10 is at a distance from the lateral walls 4, 5, 6 and 7. In particular a circumferential gap 26 between the insert plate 10 and the lateral walls 4 to 7 is formed by this. The gap 26 can amount to between 3 mm and 15 mm. Preferably this gap 26, at least in the horizontal location of the insert plate 10, is so small that objects such as cutlery or the like cannot slip through it. A finger 23 getting caught in the gap can then also be avoided in this horizontal location of the insert plate 10.

As can also be seen from FIGS. 1 to 3, the sink 1 has a drain opening 27 or an outflow. This is especially embodied in the base wall 3. Media from the receiving area 8 can drain out of the basin 2 through this drain opening 27.

Figure 4:
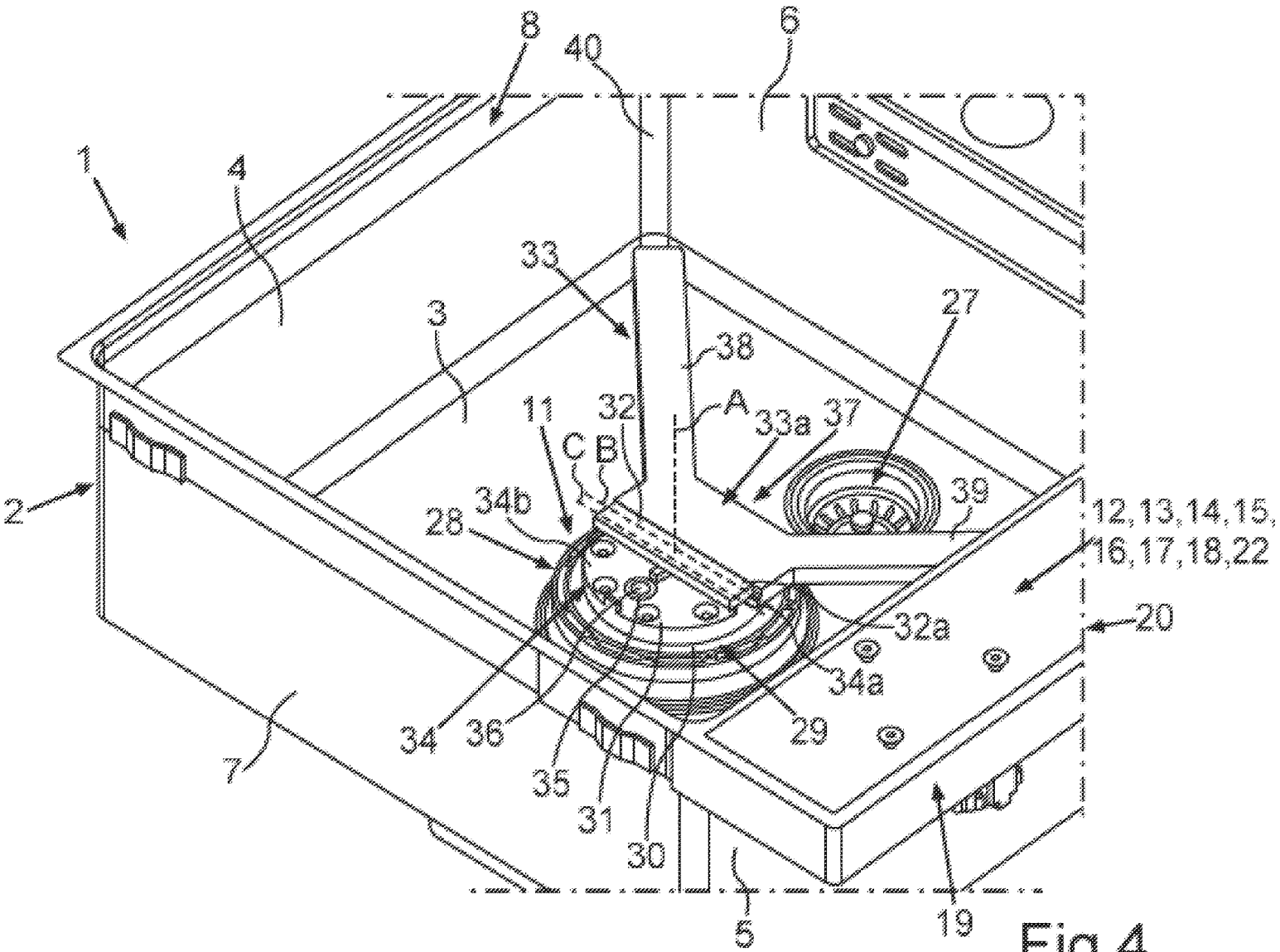
FIG. 4 shows a perspective part diagram of an exemplary embodiment of a sink with an exemplary embodiment of support vanes of a lifting apparatus.

Shown in FIG. 4 in a perspective diagram is an exemplary embodiment of a sink 1. The lifting apparatus 11 is shown. The lifting apparatus 11 has a lifting unit 28. This is especially attached centrally in the middle of the base wall 3. The lifting unit 28 is able to be moved in the direction of the axis A. In this connection the lifting unit 28 has a number of lifting segments. In FIG. 4 the lifting unit 28 is shown in the fully collapsed state. This means that it has moved downward by the maximum amount into the receiving area 8. Preferably this lifting unit 28 has an upper lifting segment 29. Arranged in an upper area 30 of this upper lifting segment 29 is a plate receptacle 31. The plate receptacle 31 here is a flat cylindrical-shaped disk. This plate receptacle 31 has a central bar 32. Arranged on this central bar 32 is a first support vane 33. The support vane 33 is in particular supported pivotably about a horizontal axis B on the central bar 32. The one-piece support vane 33 rests from above on the plate receptacle 31. An upper side 34 of this plate receptacle 31 has upper side areas 34*a* and 34*b*. These are offset downward in relation to the central bar 32. The support vane 33 rests on this upper side area 34*a*. For the purposes of improved clarity a second support vane separate from the first support vane 33 but especially the same size and shape as it, is arranged. This is supported pivotably about a further horizontal axis C on the central bar 32. The horizontal axes B and C are oriented in parallel to one another. The second support vane rests from above on the second upper side area 34*b*. In the horizontal base position an upper side 33*a* of the support vane 33 is flush with and upper side 32*a* of the central bar 32. This is embodied in a corresponding way with an upper side of the second support vane.

The support vane 33 and the second support vane not shown are arranged distanced from one another by the central bar 32. They can be pivoted independently of one another about their axes B and C. This also enables individual tilted positions of a support vane 33 relative to the horizontal plane to be set. In particular the plate receptacle 31 has a breakthrough 35 for this purpose. This breakthrough enables an actuation element to extend through the plate receptacle from below and thus in this case to make contact with the second support vane and lift it. Correspondingly a further breakthrough is embodied on the opposite side to the breakthrough 35, which is below the first support vane 33. This vane can be lifted too, in a corresponding way to that explained above. Preferably there is provision for the breakthrough 35 to be covered from above by an elastic cover 36. This elastic cover 36 makes it possible for the actuation element to project through the breakthrough 35 and to be positioned further up in relation to the upper side area 34*b* and as a result of the elastic deformation of the elastic cover 36 a corresponding protrusion of the actuation element can be brought about. This then also enables the corresponding second support vane to be lifted.

In an advantageous embodiment there is provision for the support vane 33 to project outward in a horizontal plane beyond the dimensions of the lifting unit 28. On the one hand this enables the insert plate 10 to be lifted with a single lifting unit 28. A number of separate lifting units do not have to be provided. The central positioning of the lifting unit 28 and just a single embodiment of the lifting unit 28 however also enables said unit to be embodied in this horizontal plane in a relatively space-saving way. In order in this connection not to unwantedly tilt the insert plate 10 extending well beyond it if only the lifting unit 28 were present, the support vanes 33 embodied in this regard are provided. They thus project in this horizontal plane well beyond the dimensions of the lifting unit 28. This enables the larger insert plate 10 in this regard to be contacted over a wider surface directly on its underside. An especially advantageous support structure is thus created by the support vanes 33.

The support vane 33 is in particular embodied in a V shape. To this end it has a V base 37. In addition it has two V arms 38 and 39. These project from the V base 37 away to the sides. These V arms 38, 39 are embodied freely projecting. They extend from this centrally embodied V base 37 in the direction of a corner area 40 and 41 (FIG. 5) of the basin 2. The insert plate 10 is in particular embodied as a rectangle, so that these V arms 38 and 39 also extend to the corner areas 42 and 43 (FIG. 3) of the insert plate 10 when the insert plate 10 is placed on the support vane 33 from above. The same then also applies to the extent of V arms of the second support vane not shown. The V arms of said vane then extend to corner areas 44 and 45 (FIG. 3) of the insert plate 10.

In the exemplary embodiment in FIG. 4 these V arms 38 and 39 are embodied as uninterrupted plate-type strips. The support vane 33 is embodied in one piece, in particular from plastic. The same applies to the further support vane not shown in FIG. 4.

Figure 5:
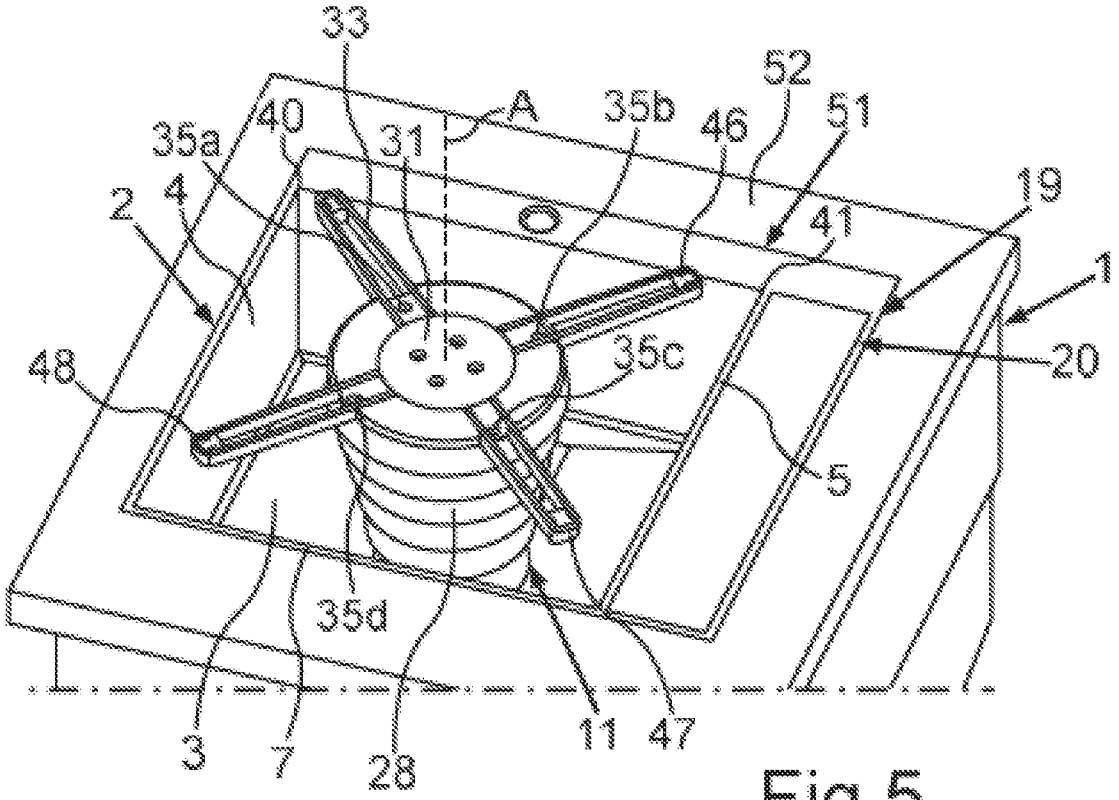
FIG. 5 shows a perspective part diagram of a further exemplary embodiment of a sink with an exemplary embodiment of support vanes of a lifting apparatus.

Shown in FIG. 5 in a further exemplary embodiment is a perspective diagram of a sink 1. In this embodiment the lifting apparatus 28 is shown in the fully extended state. This means that the lifting apparatus 28 has also moved fully upward. In this embodiment there are not two separate support vanes embodied that each have two integrated V arms 38, 39 but four separate support vanes 33, 46, 47 and 48. The support vanes 33, 46, 47 and 48 are thus each designed here as straight support arms. They are each able to be pivoted individually about horizontal axes independently of the other support vanes 33, 46 to 48. In this case corresponding actuation elements can extend through breakthroughs 35*a*, 35*b*, 35*c* and 35*d* and thus extend through them in the direction of the longitudinal axis A, in order to bring about the respective lifting of the insert plate 10. In particular these actuation elements in these embodiments act directly on the underside 10*b* of the insert plate 10. This also in this respect since these support vanes 33 and 46 to 48 are embodied as skeletons or as framework arms and thus it is made possible for these actuation elements to extend through the respective support vanes 33 and 46 to 48.

Preferably there is provision for the insert plate 10 to be coupled at a mechanical connection to the support vanes 33 in accordance with FIG. 4 and to the support vanes 33 and 46 to 48 in accordance with FIG. 5. A rotation of the insert plate 10 about the longitudinal axis is prevented by this. In particular this mechanical connection is also such that a certain holding force is embodied in the direction of the longitudinal axis A. This holding force in the axial direction is especially predetermined with an individual force threshold value. What can also be achieved by this is that, although on the one hand the insert plate 10 does not unwantedly and with slight contacts lift or tilt away from a support vane 33 or 33 and 46 to 48, on the other hand however is can also be removed in a non-destructive manner by correspondingly overcoming the force threshold value. In particular the force threshold value can also be defined so that, when an object gets caught in the gap 26, this mechanical connection is released automatically. This enables damage or injuries to be avoided. In particular this force threshold value is also defined in the axial direction so that it avoids the insert plate 10 floating if, when the insert plate is lowered with the lifting apparatus 11, water is present below the insert plate 10. This enables an undesired release of the insert plate 10 from a support vane be avoided by this when in this regard water is still present below the insert plate 10. In particular there is provision in this case for this water to be able to flow away upward above the insert plate 10 via the gap 26.

This is especially when the drain opening 27 is closed. If this drain opening 27 is open, the water can flow away in any event and does not impede the downward movement of the insert plate 10.

Figure 6:
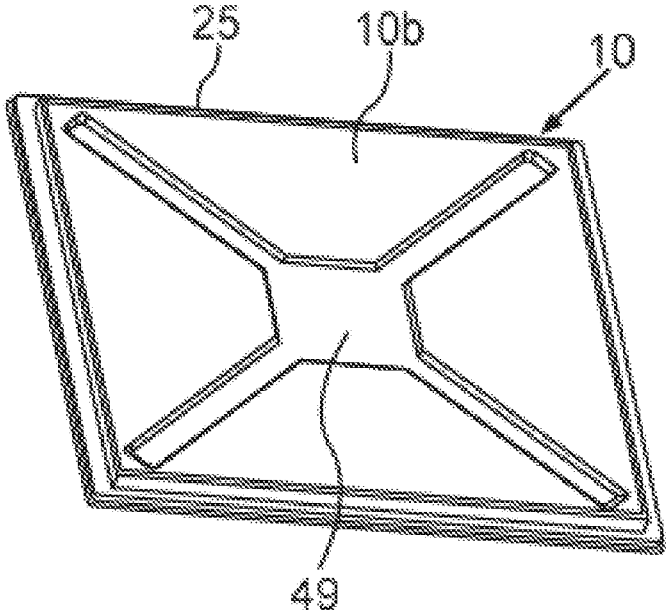
FIG. 6 shows a perspective view of an insert plate with a view of the underside.

This connection between the insert plate 10 and the support vane 33 or the support vanes 33 and 46 to 48 can for example be an interlocking connection, such as a plug connection or a snap-in connection, or a magnetic connection. Combinations of these specific connections can also be provided. In particular there is provision, as is shown in FIG. 6, for a receiving structure 49 to be embodied integrally on the underside of the insert plate 10. In the exemplary embodiment this receiving structure 49 is embodied as a recess. It has a complementary shape to the embodiment of the support vane 33 or 33 and 46 to 48. Thus these support vanes nestle down into this structure 49 when the insert plate 10 is placed on these support vanes.

In a further exemplary embodiment there can be provision, in addition to or instead of the exemplary embodiments explained previously, for the underside 10*b* to be embodied uneven. In particular this underside 10*b* can also be embodied in the shape of a pyramid or a sphere. This enables media such as air or liquid to be conveyed in a targeted manner. There can be provision for the insert plate 10 to be embodied with an air exhaust structure for exhausting any air formed under the insert plate 10 to one edge 25 of the insert plate 10. This air exhaust structure can be channels in the underside 10*b* that lead to this edge 25.

There can also be provision for the lifting apparatus 11 to have an adjustment unit 50 (FIG. 1 and FIG. 2). The adjustment unit 50 enables the support vanes 33 or 33 and 46 to 48 to be adjusted in a horizontal position into a common horizontal plane. There can also be provision for a horizontal position of at least one support vane 33 or 33 and 46 to 48 to be adjusted with the adjustment unit 50, in which an upper side 10*a* of the insert plate 10 is arranged flush with an upper side of a visual element surrounding the edge side of the insert plate 10. This visual element can for example be a decorative frame or an installation frame or an upper edge 2*a* of the basin 2.

Preferably the support vanes 33 or 33 and 46 to 48 extend as far as an outer third of the surface of the insert plate 10.

Preferably the support vanes 33 or 33 and 46 to 48 are able to be removed from the lifting unit 28 and put back onto it in a non-destructive manner.

A diagram in which the sink 1 is inserted into a cutout 51 of a worktop 52 is shown merely by way of example in FIG. 5.

A dismantling mode different from the normal mode of the lifting unit of the lifting unit 28 can also be set. In this mode the lifting unit 28 is set beyond the maximum raised position of the lifting unit 28 in the normal mode and thus also sets the corresponding position of the insert plate 10 to a position lying even higher in the height direction. In the maximum raised position in normal mode there is in particular provision for the upper side 10*a* of the insert plate 10 to be flush with the upper side of the upper edge 2*a* of the basin 2 or with a decorative frame or an installation frame. In the dismantling position lying higher than this, the insert plate 10 is preferably positioned so that it is arranged with its underside 10*b* higher than this upper edge 2*a* by a vertical distance. In particular this vertical distance amounts to at least 2 cm, especially to 3 cm. This enables an edge 25 the insert plate 10 to be grasped with a hand and held securely to remove it from the lifting unit. The dismantling position is in particular a horizontal location of the insert plate 10. The underside 10*b* of the insert plate 10 is thus positioned entirely above the upper edge 2*a*.

The invention claimed is:

1. A sink, comprising:

a basin including a base wall and lateral walls adjoining the base wall, said basin having a receiving area delimited by the base wall and the lateral walls;

an insert plate separate from the basin and inserted into the receiving area of the basin; and a lifting apparatus configured to move the insert plate relative to the basin, said lifting apparatus including a lifting unit and at least two support vanes on which the insert plate sits, said at least two support vanes being arranged on an upper end of the lifting unit and configured to protrude laterally in a horizontal plane beyond the lifting unit, wherein the lifting unit includes an upper lifting segment on which at least one of the at least two support vanes is arranged, and the at least one of the at least two support vanes is movably arranged on the upper lifting segment of the lifting unit.

2. The sink of claim 1, wherein the at least one of the at least two support vanes is supported pivotably about a horizontal axis on the upper lifting segment.

3. The sink of claim 1, wherein at least one of the at least two support vanes is embodied as a V-shaped bracket.

4. The sink of claim 1, wherein the insert plate is arranged on the at least two support vanes by a connection that is releaseable in a non-destructive manner.

5. The sink of claim 4, wherein the connection includes a plug connection.

6. The sink of claim 4, wherein the connection is a magnetic connection or a snap-in connection.

7. The sink of claim 1, wherein the insert plate is configured in at least one of three ways, a first way in which an underside of the insert plate has a pyramid shape, a second way in which an underside of the insert plate has a spherical shape, a third way in which the insert plate includes an air exhaust structure for conveying air formed under the insert plate toward an edge of the insert plate.

8. The sink of claim 1, further comprising a visual element in surrounding relation to an edge side of the insert plate, said lifting apparatus including an adjustment unit with which the at least two support vanes are adjustable in a horizontal position in a common horizontal plane and/or with which the at least two support vanes are adjustable in a horizontal position in which an upper side of the insert plate is flush with an upper side of the visual element.

9. The sink of claim 1, wherein the at least two support vanes project as far as an outer third of a surface of the insert plate.

10. The sink of claim 1, wherein the upper lifting segment has an upper side formed with a central bar raised upward, said at least two support vanes being pivotably supported on opposite sides of the central bar.

11. The sink of claim 10, wherein the upper side of the upper lifting segment has upper side areas which adjoin the central bar and on which the at least two support vanes rest in a base position.

12. The sink of claim 1, wherein the insert plate has an upper side having a surface that amounts to at least 80% of a surface of the receiving area in a horizontal plane, but is less than 99% of the surface of the receiving area.

13. The sink of claim 1, wherein the insert plate has an upper side having a surface that amounts to at least 90% of a surface of the receiving area in a horizontal plane, but is less than 99% of the surface of the receiving area.

14. The sink of claim 1, wherein the insert plate has an upper side having a surface that amounts to at least 95% of a surface of the receiving area in a horizontal plane, but is less than 99% of the surface of the receiving area.

15. A sink, comprising:

a basin including a base wall and lateral walls adjoining the base wall, said basin having a receiving area delimited by the base wall and the lateral walls;

an insert plate separate from the basin and inserted into the receiving area of the basin; and a lifting apparatus configured to move the insert plate relative to the basin, said lifting apparatus including a lifting unit and at least two support vanes on which the insert plate sits, said at least two support vanes being arranged on an upper end of the lifting unit and configured to protrude laterally in a horizontal plane beyond the lifting unit, wherein the at least two support vanes are moveable independently of one another relative to the lifting unit.

* * * * *